US006008479A

United States Patent [19]

Jiang et al.

[11] Patent Number: 6,008,479

[45] Date of Patent: Dec. 28, 1999

[54] MOLYBDENUM DISILICIDE CERAMIC COMPOSITE INFRARED RADIATION SOURCE OR HEATING SOURCE

[75] Inventors: Wan Jiang; Kenichi Tsuji; Tetsuo Uchiyama, all of Tokyo; Mutsumi Nagumo, Kawasaki; Satoru Sakaue, Kawasaki; Masahiro Uno, Kawasaki, all of Japan

[73] Assignees: Fuji Electric Co., Ltd., Kawasaki, Japan; Kabushiki Kaisha Riken, Tokyo, Japan

[21] Appl. No.: 08/938,966

[22] Filed: Sep. 26, 1997

[30] Foreign Application Priority Data

Sep. 27, 1996 [JP] Japan ..... 8-256784

[51] Int. Cl.[6] ..... H05B 3/10

[52] U.S. Cl. ..... 219/553; 219/270; 219/464

[58] Field of Search ..... 219/553, 270, 219/464, 544, 541; 392/407; 252/516

[56] References Cited

U.S. PATENT DOCUMENTS

| | | | |
|---|---|---|---|
| 4,433,233 | 2/1984 | Hierholzer, Jr. et al. | 219/553 |
| 5,338,616 | 8/1994 | Ishii et al. | 428/472 |
| 5,591,368 | 1/1997 | Fleischhauer et al. | 219/535 |

FOREIGN PATENT DOCUMENTS

| | | |
|---|---|---|
| 60-195061 | 10/1985 | Japan . |
| 1-115876 | 5/1989 | Japan . |
| 5-296833 | 11/1993 | Japan . |
| 8-198680 | 8/1996 | Japan . |

*Primary Examiner*—Teresa Walberg
*Assistant Examiner*—Thor S. Campbell
*Attorney, Agent, or Firm*—Venable; Robert J. Frank; Jeffrey W. Gluck

[57] ABSTRACT

In an infrared radiation source containing hot-pressed molybdenum disilicide reinforced with silicon carbide whiskers as the illuminant thereof, terminal portions of the illuminant having a protective dense silica film of 5 to 20 $\mu$m in thickness formed on the surface thereof which portions are to be heated at a temperature of 400 to 800° C. are either set to have a current density of at most 12 A/mm$^2$ or disposed in dry air having a relative humidity at 25° C. of at most 30% (absolute humidity: 0.00588). As a result, the low-temperature oxidation phenomenon that would otherwise be developed in the terminal portions of the illuminant is suppressed. Thus, there can be obtained an infrared radiation source containing an illuminant made of molybdenum disilicide reinforced with silicon carbide whiskers and having a long serviceable life span.

33 Claims, 3 Drawing Sheets

FORMATION OF DIFFERENTIAL TEMPERATURE CELL

DC ELECTRICITY FLOW

DC ELECTRICITY FLOW+DIFFERENTIAL TEMPERATURE CELL

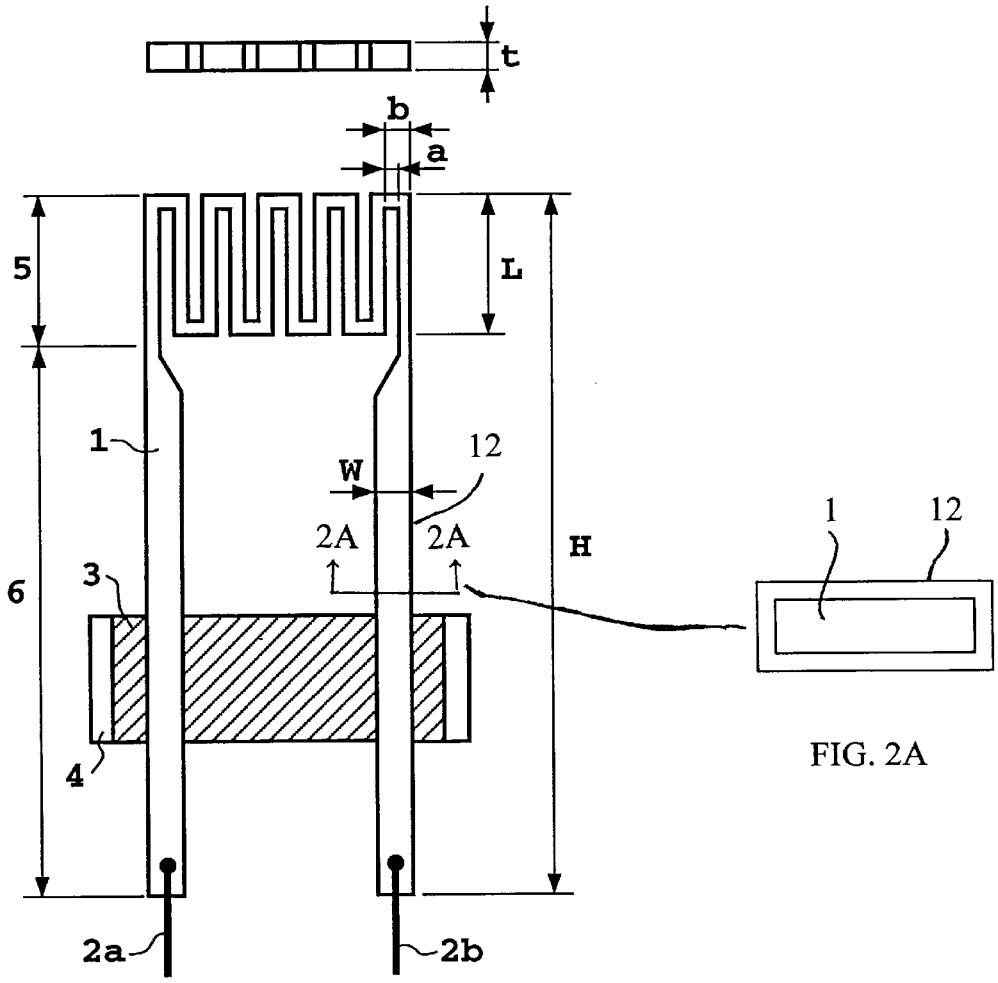
FIG. 2A
FIG. 2
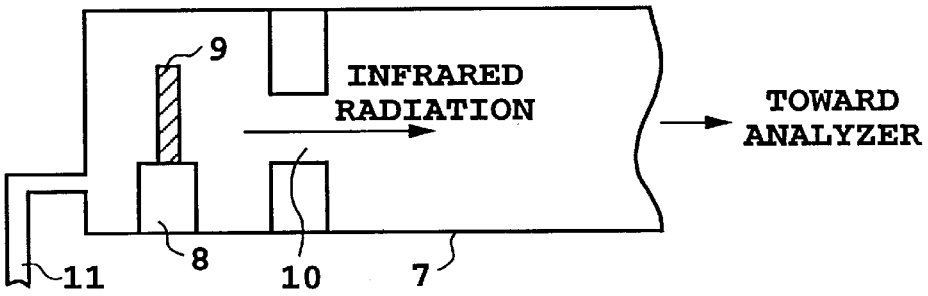
FIG. 3

MOLYBDENUM DISILICIDE CERAMIC COMPOSITE INFRARED RADIATION SOURCE OR HEATING SOURCE

BACKGROUND OF THE INVENTION

1. Field of the Invention

The present invention relates to an infrared radiation source wherein hot-pressed molybdenum disilicide reinforced with silicon carbide whiskers is used as the illuminant thereof, or a heating source wherein hot-pressed molybdenum disilicide reinforced with silicon carbide whiskers is used as the heating element thereof, and particularly to an infrared radiation source or heating source, which is prevented from low-temperature oxidation of terminal portions of the illuminant or heating element during use of the infrared radiation source or heating source to prolong the life span of the infrared radiation source or heating source, and which is applied to an infrared analyzer, a heater in an industrial furnace, or the like.

2. Description of the Related Art

Utilization of a molybdenum disilicide illuminant in a radiation source in a gas analyzer using infrared radiation has been attempted by making much of an advantage that a high luminance can be secured by heating it up to a high temperature. Since molybdenum disilicide has a low resistivity of 0.0003 Ω·cm, however, a large electric current is necessary for heating molybdenum disilicide up to a high temperature, thus resulting in a large power consumption. Molybdenum disilicide also involves a practical problem that the shape of an illuminant or heating element made thereof cannot be retained because of its creep deformation at high temperatures.

A heating element capable of reducing the power consumption thereof to a low level, which is produced by forming molybdenum disilicide into a fine wire to thereby increase the apparent resistance thereof, has been proposed according to a technology of solving one of the foregoing problems in Japanese Patent Application Laid-Open No. 296,833/1993.

On the other hand, a technology of molybdenum disilicide composite reinforced with silicon carbide whiskers is disclosed as a method of suppressing the creep deformation of molybdenum disilicide at high temperatures in Japanese Patent Application Laid-Open No. 198,680/1996.

Meanwhile, a DC power source is usually used as a power source for supplying electricity to an illuminant in an infrared gas analyzer because it is important to generate a stable amount of infrared radiation. The inventors of the present invention have found out that, in many cases where an illuminant made of molybdenum disilicide reinforced with silicon carbide whiskers is heated up to and kept at a temperature necessary for infrared analysis, e.g., 1,300° C., by supplying DC electricity to the illuminant, oxidation of a terminal portion thereof connected with the positive electrode of a direct current source and heated in the temperature range of 400 to 800° C. not directly involved in infrared radiation emission, particularly at around 500° C., preferentially proceeds to lose the function of flowing electricity in this portion, whereby the serviceable life span of a radiation source comprising the illuminant is completed.

An infrared radiation source in particular is desired to have a life span of at least 10,000 hours.

In view of this, any radiation source made of molybdenum disilicide capable of providing a high luminance while satisfying such a long life span, if obtained, is believed to serve to improve the precision of an infrared gas analyzer and hence to greatly contribute to analytical chemistry.

Molybdenum disilicide also is generally used as a heating element for an industrial furnace wherein a ceramic or the like is fired in the air. In this case as well, the heating element is often fractured because low-temperature oxidation of molybdenum disilicide, which is peculiar to molybdenum disilicide, proceeds in the low temperature range of at most 1,000° C., particularly in a temperature range of around 500° C. In order to prevent such low-temperature oxidation, the heating element made of molybdenum disilicide is usually preliminarily subjected to a pre-oxidation treatment at a high temperature of at least 1,000° C. for formation of a dense silica film on the surface thereof, after which it is used. However, the low-temperature oxidation mentioned above occurs predominantly at a terminal portion of the illuminant on the positive electrode's side, although the protective silica film is formed on the surface by means of a pre-oxidation technique which is prevalently done for the heating element of an industrial furnace. This low-temperature oxidation leads to a fracture of the protective silica film and further proceeds inward.

Accordingly, an object of the present invention is to provide an infrared radiation source comprising an illuminant made of molybdenum disilicide reinforced with silicon carbide whiskers and having a long life span as well as a heating source comprising a heating element made of molybdenum disilicide reinforced with silicon carbide whiskers and having a long life span by suppressing the low-temperature oxidation phenomenon thereof which proceeds in a terminal portion thereof where it is connected with the positive terminal of a DC power source.

As described hereinabove, molybdenum disilicide can be used as a heat-resistant material in an atmosphere of air up to a high temperature of 1,800° C. since the protective silica film can exhibit an excellent oxidation resistance in the atmospheric environment. When it is used in the low-temperature range of less than 1,000° C., particularly in a temperature range of around 500° C., low-temperature oxidation peculiar to molybdenum disilicide proceeds to fracture molybdenum disilicide. In view of the above, a method wherein molybdenum disilicide is preliminarily subjected to a pre-oxidation treatment at a high temperature of at least 1,000° C. to form a dense silica film on the surface thereof has hitherto been employed with a view to preventing low-temperature oxidation of molybdenum disilicide. However, a long life span of molybdenum disilicide cannot be secured only by this method.

Specifically, when the infrared radiation source comprising the illuminant made of molybdenum disilicide reinforced with silicon carbide whiskers is used, the illuminant is self-heated up to a necessary radiation source temperature by means of a DC power source. In this case, a terminal portion of the illuminant on the positive electrode's side thereof, the temperature of which portion stays as low as around 500° C., undergoes rapid progress of low-temperature oxidation despite the existence of the dense silica film on the surface thereof, whereby the serviceable life span of the radiation source is greatly affected. Thus, there is a need of taking a measure for prolonging the life span of an infrared radiation source comprising an illuminant.

The low-temperature oxidation behavior is also in relation with the relative density to theoretical of the material and the state of a silica film formed on the surface thereof. This behavior further differs from season to season. Since the rate of low-temperature oxidation is faster in summer than in winter, there has also been a suggestion that moisture in the air may be another factor in greatly affecting low-temperature oxidation.

SUMMARY OF THE INVENTION

In a first aspect of the present invention, there is provided an infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, the current density in the terminal portions being at most 12 $A/mm^2$.

In a second embodiment of the first aspect of the present invention, the current density may be at most 10 $A/mm^2$.

In a second aspect of the present invention, there is provided an infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, at least the terminal portions being disposed in dry air having a relative humidity at 25° C. of at most 30% (absolute humidity: 0.00588).

Here, the whole body of the illuminant may be contained in a case wherein dry air is either sealed or flowed, and which is provided with a window for allowing outward emergence of infrared radiation.

At least the terminal portions may be disposed in dry air having an absolute humidity of substantially zero.

The whole body of the illuminant may be contained in a case wherein dry air is either sealed or flowed, and which is provided with a window for allowing outward emergence of infrared radiation.

In a third aspect of the present invention, there is provided an infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, a current density in the terminal portions being at most 12 $A/mm^2$, at least the terminal portions being disposed in dry air having a relative humidity at 25° C. of at most 30% (absolute humidity: 0.00588).

Here, the whole body of the illuminant may be contained in a case wherein dry air is either sealed or flowed, and which is provided with a window for allowing outward emergence of infrared radiation.

In a first aspect, a second aspect and a third aspect of the present invention, the illuminant may be a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes which is at least 98% of the 5 hours, and having a relative density to theoretical density.

In a first aspect, a second aspect and a third aspect of the present invention, the protective silica film may be obtained by subjecting the hot-pressed molybdenum disilicide reinforced with silicon carbide whiskers to a pre-oxidation treatment in an atmosphere of air at a temperature 1,500 to 1,700° C.

In a fourth aspect of the present invention, there is a heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, a current density in the terminal portions being at most 12 $A/mm^2$.

In a second embodiment of the fourth aspect of the present invention, the current density may be at most 10 $A/mm^2$.

In a fifth aspect of the present invention, there is provided a heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, at least the terminal portions being disposed in dry air having a relative humidity at 25° C. of at most 30% (absolute humidity: 0.00588).

Here, the whole body of the heating element may be contained in a case wherein dry air is either sealed or flowed, and which is provided with a window for allowing outward emergence of infrared radiation.

At least the terminal portions may be disposed in dry air having an absolute humidity of substantially zero.

The whole body of the heating element may be contained in a case wherein dry air is either sealed or flowed, and which is provided with a window for allowing outward emergence of infrared radiation.

In a sixth aspect of the present invention, there is provided a heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, a current density in the terminal portions being at most 12 $A/mm^2$, at least the terminal portions being disposed in dry air having a relative humidity at 25° C. of at most 30% (absolute humidity: 0.00588).

Here, the whole body of the heating element may be contained in a case wherein dry air is either sealed or flowed, and which is provided with a window for allowing outward emergence of infrared radiation.

In a fourth aspect, a fifth aspect and a sixth aspect of the present invention, the heating element may be a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

In a fourth aspect, a fifth aspect and a sixth aspect of the present invention, the protective silica film may be obtained by subjecting the hot-pressed molybdenum disilicide reinforced with silicon carbide whiskers to a pre-oxidation treatment in an atmosphere of air at a temperature 1,500 to 1,700° C.

As described above, according to the present invention, an infrared radiation source or heating source comprising an illuminant or heating element made of hot-pressed molybdenum disilicide reinforced with silicon carbide whiskers is suppressed in the low-temperature oxidation phenomenon thereof that would otherwise proceed preferentially in a positive terminal portion thereof where the temperature thereof falls within a temperature range of around 500° C. under DC conditions, whereby the serviceable life span of the infrared radiation source or heating source comprising the illuminant or heating element can be prolonged. The infrared radiation source thus improved in life span serves to improve the precision of an infrared gas analyzer and makes a great contribution in the field of analytical chemistry. The life span of the radiation source can also be prolonged to a maximum extent.

The above and other objects, effects, features and advantages of the present invention will become more apparent from the following description of the embodiments thereof taken in conjunction with the accompanying drawings.

BRIEF DESCRIPTION OF THE DEAWINGS

FIG. 2 is a diagram showing an example of an illuminant in an infrared radiation source;

FIG. 2A is a diagram showing a cross-sectional view of the illuminant of FIG. 2; and FIG. 3 is a diagram showing an example of the surroundings of an infrared radiation source.

DETAILED DESCRIPTION OF PREFERRED EMBODIMENTS

A study resulting in completion of the present invention will now be described in more detail.

The life span of a resistance heating element or a resistance illuminant (the following explanation will sometimes be made while referring to only one of the illuminant and the heating element, but will apply to both of them except for examples presented hereinafter and unless otherwise specified) is generally in such close relation with the surface load and the current density that the heating element is designed in such a way as not to exceed a predetermined surface load and/or current density.

Figure 1A:
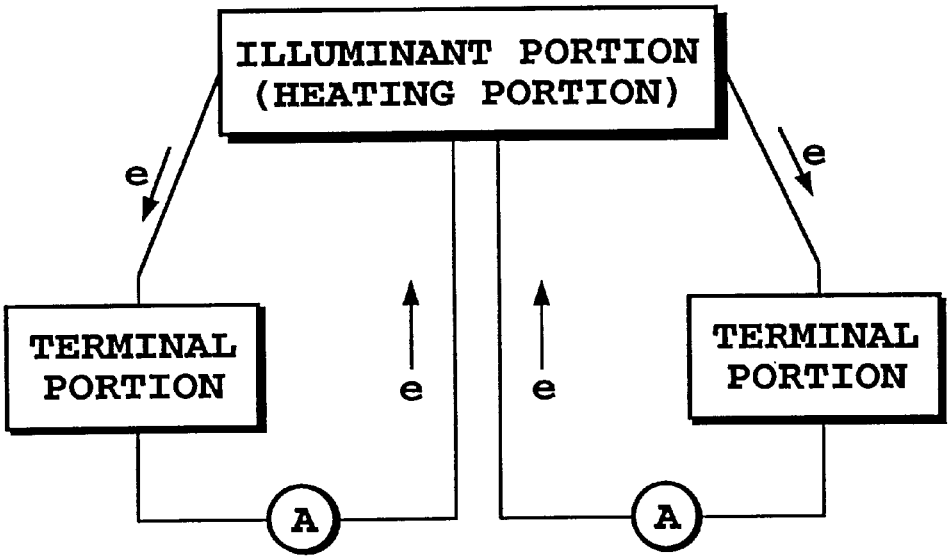
FIG. 1A is an illustration showing the electron flow in a differential temperature cell.
Figure 1B:
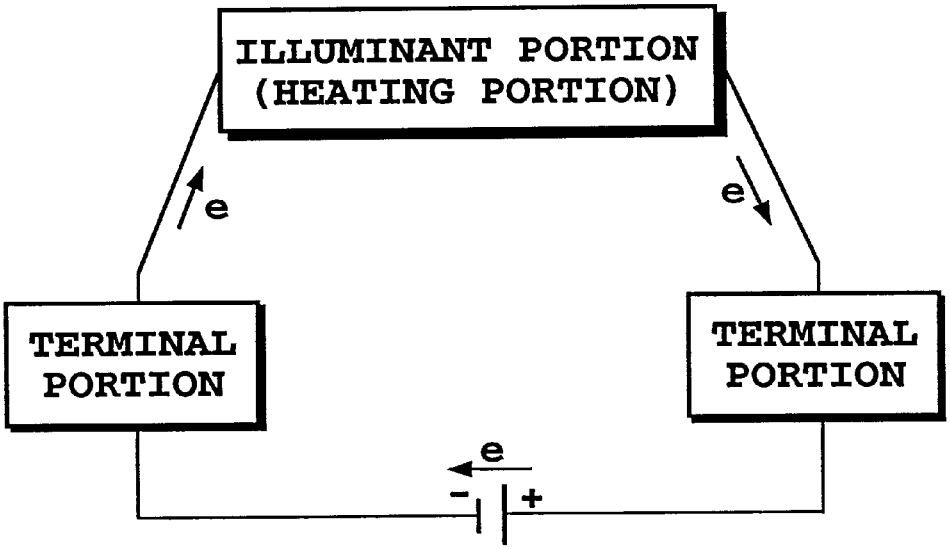
FIG. 1B is an illustration showing the electron flow when DC electricity is supplied.
Figure 1C:
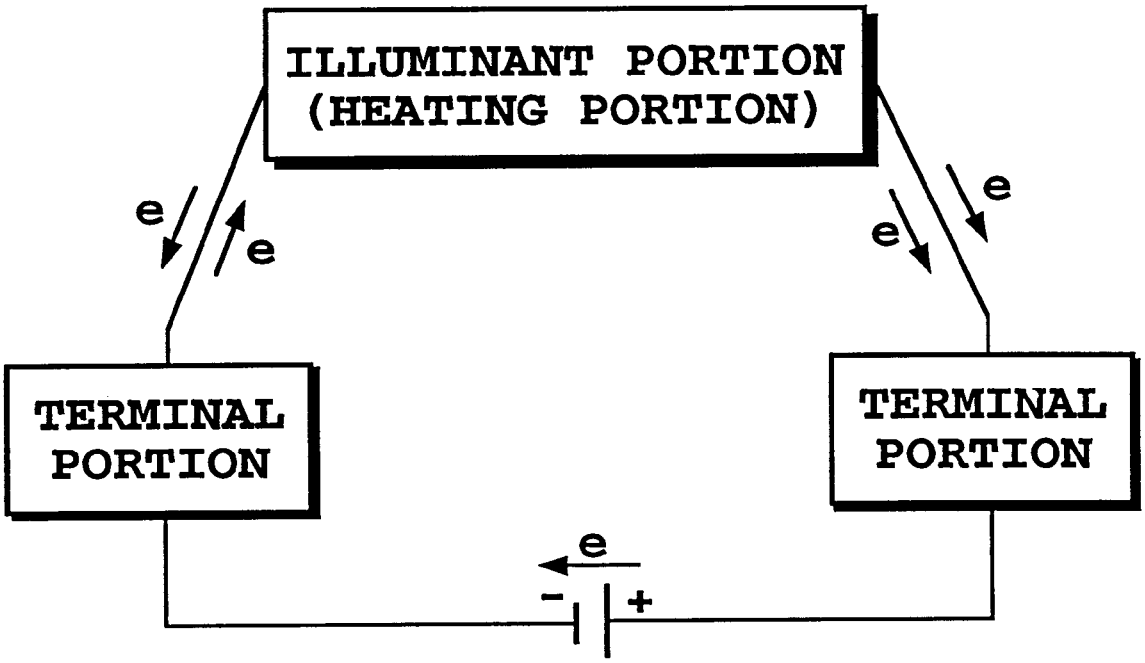
FIG. 1C is an illustration showing electron flows in a differential temperature cell when DC electricity is supplied therethrough.

On the other hand, when DC electricity is supplied to the illuminant, an electron flow from an illuminant portion toward both positive and negative terminal portions, which flow is developed by formation of a differential temperature cell as shown in FIG. 1A, and an electron flow from a negative electrode toward a positive electrode, which flow is developed by a DC electricity supply as shown in FIG. 1B, are typically conceivable as the electron flows. Thus, the combination of FIG. 1A with FIG. 1B makes it understandable that more electrons flowed into the terminal portion of the illuminant on the side of the positive electrode than into the terminal portion on the side of the negative electrode as shown in FIG. 1C, whereby an electrochemical reaction such as an oxidation reaction is acceleration to a greater extent in the former terminal portion. It was further confirmed that this oxidation reaction, which differs from season to season, is higher in the rate of oxidation in summer than in winter.

With consideration given to the foregoing, the inventors of the present invention have found that, in the case of selecting hot-pressed molybdenum disilicide reinforced with silicon carbide whiskers as a radiation source or heating source material, the life span h of either an infrared radiation source provided with an illuminant made of hot-pressed molybdenum disilicide reinforced with silicon carbide whiskers or a heating source provided with a heating element made of hot-pressed molybdenum disilicide reinforced with silicon carbide is represented by the following empirical formula (1):

$$h=A/\{f(\mathrm{Id})\cdot g(m)\} \quad (1)$$

wherein f(Id) is monotonically increasing function of current density in the illuminant or the heating element; g(m) is aimonotonically increasing function of the moisture content of the air; and A is a constant.

Thus, the oxidation reaction at a low temperature is suppressed to prolong the life span of the radiation source when the current density in the terminal portion is controlled to be as low as possible and/or when the terminal portion is placed in a low-moisture (low-humidity) atmosphere.

Of course, this is based on the premise that a surface-protective dense silica film is preliminarily formed through a pre-oxidation treatment at a high temperature.

A first invention completed based on the foregoing study is an infrared radiation source produced using hot-pressed molybdenum disilicide reinforced with silicon carbide whiskers as the illuminant thereof; characterized in that the current density is set to be at most 12 A/mm$^2$ in a portion where the temperature stays at 400 to 800° C., specifically in a terminal portion of the illuminant. When the current density exceeds 12 A/mm$^2$ in the terminal portion, low-temperature oxidation of the terminal portion is so rapid that the required life span of the infrared radiation source cannot be satisfied. The infrared radiation source is preferably used under such conditions as to make the current density at most 10 A/mm$^2$. In order to lower the current density, the cross-sectional area of the terminal portion is increased (the thickness of the terminal portion is increased because width>thickness in general). This may be considered unfavorable from the standpoint of power consumption because of a decrease in resistance for an increase in the cross-sectional area. Within the range of at most 30 W, however, this is not particularly problematic.

A specific embodiment of the present invention is shown in FIG. 2, wherein numeral 1 refers to an illuminant made of molybdenum disilicide reinforced with silicon carbide whisker. Lead wires 2*a* and 2*b* made of platinum are welded to both ends of the illuminant 1 to form an electrode. The illuminant 1 is fixed in a ceramic tube 4 made of, for example, alumina with a heat-resistant adhesive 3. A portion 5 of the illuminant 1 is an illuminant portion, while portions 6 of the illuminant 1 are terminal portions. Accordingly, when an electric current is supplied through the illuminant via the lead wires 2*a* and 2*b*, the illuminant 1 is heated to emit infrared radiation.

A second invention is an infrared radiation source produced using hot-pressed molybdenum disilicide reinforced with silicon carbide whiskers as the illuminant thereof; characterized in that at least a terminal portion of the illuminant is used in an atmosphere of dry air having a relative humidity at 25° C. of at most 30% (absolute humidity: 0.00588). Herein, the absolute humidity x is represented by the following formula (2), which is shown in "KAITEI 3 PAN NETSU KANRI BINRAN (REVISED EDITION 3 HEAT CONTROL MANUAL)," page 90, published by Maruzen K. K. on Jan. 20, 1986 and edited by Energy Saving Center:

$$x=0.622\ \{\phi Ps/(P-\phi Ps)\} \quad (2)$$

wherein $\phi$ is relative humidity; P is total pressure; and Ps is the saturation pressure of water vapor.

In an atmosphere having a relative humidity exceeding 30% at 25° C., the terminal portion 6 is so rapidly oxidized at a low temperature that the required life span of the infrared radiation source cannot be satisfied. It is preferred that the terminal portion be used in dry air having an absolute humidity substantially close to 0%.

In order to avoid the influence of moisture in the air, which greatly affects low-temperature oxidation of the terminal portion on the positive electrode's side of the illuminant made of molybdenum disilicide reinforced with silicon carbide whiskers, the present invention further provides an infrared radiation source wherein dry air is flowed around an infrared radiation source to keep the environment free of moisture. More specifically, in accordance with the present invention, there is provided an infrared radiation source comprising an illuminant, and a case containing the whole body of the illuminant in which case dry air is either sealed or flowed, the case being provided with a window for allowing outward emergence therethrough of infrared radiation. To put it more concretely, as shown in FIG. 3, an illuminant holder 8 in contact with the case 7 and the whole body of the illuminant 9 are contained inside the case 7. Only the suitable window 10 is opened in the direction of emergence of infrared radiation, while the portion of the case other than the window is in a sealed form. When the radiation source is lit up, the surroundings therearound are wholly filled up with dry air, or dry air is flowed into the surroundings via a gas feeding inlet 11.

Although the first invention and the second invention are in independent relation with each other, combination of conditions for both can further prolong the life span of the radiation source.

Limitation requirements in the present invention will now be described in detail.

A precondition of the first invention and the second invention is that a surface-protective dense silica film 12 (FIGS. 2 and 2A) of 5 to 20 $\mu$m in thickness must be formed on the surface of the illuminant for use in the infrared radiation source through a pre-oxidation treatment at a high temperature. When the thickness of the surface-protective silica film is smaller than 5 $\mu$m, the surface-protective silica film is fractured comparatively early to allow progress of low-temperature oxidation to fail in satisfying the required life span of the infrared radiation source. On the other hand, when the thickness of the surface-protective silica film exceeds 20 $\mu$m, a problem of delamination of the protective film unfavorably arises the other way around.

The surface-protective silica film is formed by effecting the pre-oxidation treatment in an atmosphere of air at a temperature of 1,500 to 1,700° C. over a necessary period of time. A temperature lower than 1,500° C. is unrealistic because the thickness of the protective silica film cannot become 5 $\mu$m or larger even if the oxidation treatment is continued for a long period of time of 10 hours. On the other hand, as described following experimental examples, a temperature exceeding 1,700° C. involves a difficulty in forming a dense and homogeneous silica film because the rate of oxidation is too rapid.

A mixed powder of molybdenum disilicide combined with silicon carbide whiskers of 25% by volume was hot-pressed under conditions as shown in Table 1. The density of the resulting composite relative to the theoretical density of the composite is also shown in Table 1.

TABLE 1

| Exp. Ex./ Comp. Exp. Ex. | Temperature (° C.) | Pressure (kg/cm$^2$) | Time (h) | Relative Density to Theoretical (%) |
|---|---|---|---|---|
| Exp. Ex. 1 | 1750 | 300 | 1 | 98.1 |
| Exp. Ex. 2 | 1750 | 500 | 1 | 98.6 |
| Comp. Exp. Ex. 1 | 1650 | 300 | 1 | 94.5 |
| Comp. Exp. Ex. 2 | 1750 | 0 | 1 | 94.5 |
| Comp. Exp. Ex. 3 | 1800 | 0 | 1 | 95.8 |

It can be understood from Table 1 that a relative density of the composite with respect to its theoretical density of at least 98% can be secured through hot-pressing under a pressure of at least 300 kg/cm$^2$ at 1,750° C. for 1 hour, whereas extreme difficulty is encountered in obtaining a high-density sintered composite without utilization of a hot-pressing method. Meanwhile, when the sintering temperature was lower than 1,700° C., the resulting sintered composite was not sufficiently densified even using the hot-pressing method.

A ceramic composite (molybdenum disilicide reinforced with silicon carbide whiskers) radiation source material having 98.6% of theoretical density and a ceramic composite (molybdenum disilicide reinforced with silicon carbide whiskers) radiation source material having 95.8% of theoretical density were each subjected to a pre-oxidation treatment at a temperature of 1,400 to 1,700° C. for 2 to 10 hours to form a silica film, the thickness of which is shown in Table 2.

TABLE 2

| Exp. Ex./ Comp. Exp. Ex. | Relative Density to Theoretical (%) | Treatment Temperature (° C.) | Treatment Time (h) | Film Thickness ($\mu$m) |
|---|---|---|---|---|
| Exp. Ex. 3 | 98.6 | 1500 | 10 | 5.4 |
| Exp. Ex. 4 | 98.6 | 1600 | 2 | 5.2 |
| Exp. Ex. 5 | 98.6 | 1600 | 5 | 8.1 |
| Exp. Ex. 6 | 98.6 | 1600 | 10 | 10.2 |
| Exp. Ex. 7 | 98.6 | 1700 | 5 | 12.7 |
| Comp. Exp. Ex. 4 | 98.6 | 1400 | 5 | 0.6 |
| Comp. Exp. Ex. 5 | 95.8 | 1600 | 5 | 5.3 |

In the ceramic composite radiation source material, the thickness of the silica film on the surface thereof is increased as the pre-oxidation treatment temperature or time is raised or increased. When a material having 98.6% of theoretical density is subjected to a pre-oxidation treatment at 1,600° C. over 5 hours, a film having a uniform and given thickness can be formed. On the other hand, in the case of a material having a relatively low density (Comp. Exp. Ex. 5), a film having a predetermined thickness may be obtained, but is unfavorably subject to rapid low-temperature oxidation after the film is once fractured.

For the above-mentioned reason, an increase in the relative density to theoretical of the material is effective in preventing the molybdenum disilicide material from undergoing low-temperature oxidation. In order to raise the relative density to theoretical of molybdenum disilicide reinforced with silicon carbide whiskers to at least 98%, a mixed powder of silicon carbide whiskers and molybdenum disilicide must be hot-pressed under a pressure of 200 to 500 kg/cm$^2$ at a temperature of 1,700 to 1,850° C. over a period of time of 10 minutes to 5 hours. The material of the infrared radiation source made of molybdenum disilicide reinforced with silicon carbide whiskers is preferably produced according to the foregoing hot-pressing method to have a relative density to theoretical of at least 98%.

The following Examples will illustrate the present invention in more detail.

EXAMPLES

Example 1

Molybdenum disilicide reinforced with silicon carbide whiskers was hot-pressed to be a 50ϕ×2 mm disc having a relative density to theoretical of at least 98%, which was then surface-polished into a thin plate of 0.5 mm in thickness, which was then formed into an illuminant 1 as shown in FIG. 2 according to a precision machining method such as wire cutting. Herein, dimensions as shown in FIG. 2 were such that a=0.25 mm, b=0.3 mm, H=18 mm, h=3.5 mm, t=0.5 mm, and W=1.0 mm. The illuminant formed by such precision micromachining was subjected to a pre-oxidation treatment in an air furnace at 1,600° C. for 5 hours to form a protective silica film of 9 μm in thickness on the surface of the illuminant.

When the resulting illuminant was heated to 1,300° C., the electric current was 5 A and the voltage was 3 V with a power consumption of 15 W. The current density in the terminal portions was found by conversion to be 10 A/mm$^2$. As a result of continuous lighting under such conditions, the life span h of the illuminant was 11,060 hours.

The environment involved in this test was such that the temperature was 23° C. and the relative humidity was 60%.

Example 2

An illuminant was formed in the same manner as in Example 1 except that the thickness of the illuminant was set to be 0.7 mm. When the illuminant was heated to 1,300° C. in the same way as in Example 1, the electric current was 5.9 A and the voltage was 2.2 V. The current density in the portions was found by conversion to be 8.4 A/mm$^2$. When the illuminant was continuously lighted under the conditions mentioned above, the life span h of the illuminant was 13,230 hours.

Comparative Example 1

An illuminant was formed in the same manner as in Example 1 except that the thickness of the illuminant was set to be 0.25 mm. When the illuminant was heated to 1,300° C. in the same way as in Example 1, the electric current was 3.6 A and the voltage was 3.9 V. The current density in the portions was found by conversion to be 14.4 A/mm$^2$. When the illuminant was continuously lighted under the conditions mentioned above, the life span of the illuminant was 6,900 hours.

Examples 3 to 5

Illuminants were respectively formed in the same manner as in Example 1 and 2 and Comparative Example 1, and then subjected to a continuous lighting test under substantially the same conditions as in Example 1 except that the environment involved in the test was such that the temperature was 25° C. and the relative humidity was 20%. The life spans h in hours of the illuminants in this test are shown in Table 3.

TABLE 3

| Ex. | Thickness of Illuminant (mm) | Temperature of Illuminant (° C.) | Current Density (A/mm$^2$) | Life Span (h) |
|---|---|---|---|---|
| Ex. 3 | 0.5 | 1300 | 10 | 13460 |
| Ex. 4 | 0.7 | 1300 | 8.4 | 16525 |
| Ex. 5 | 0.25 | 1300 | 14.4 | 10690 |

Example 6

An illuminant was formed in the same manner as in Example 1, and then subjected to a continuous lighting test under substantially the same conditions as in Example 1 except that the whole body of the illuminant was placed in dry air having an absolute humidity substantially close to 0. The life span of the illuminant was 23,400 hours.

Example 7 and Comparative Example 2

In Example 7 and Comparative Example 2, the same illuminants as in Experimental Example 5 and Comparative Experimental Example 5 in Table 2 were subjected to an oxidation resistance test which was conducted by heating the illuminants up to 1300° C. in the same way as in Example 1, except that the enviroment involved in the test was such that the temperature was 30° C. The results are shown in Table 4, wherein the oxidation starting time is a point of time when the dense silica film covering the surface of the terminal portion of the illuminant on the plus eletrode's side thereof, the temperature of which portion stays as low as around 500° C., began to be destroyed, and the rate of oxidation is a rate at which the terminal portion became thinner and thinner in keeping with the progress of low-temperature oxidation.

TABLE 4

| Ex./Comp. Ex. | Oxidation Starting Time (h) | Rate of Oxidation (μm/h) |
|---|---|---|
| Ex. 7 | 320 | $8.2 \times 10^{-2}$ |
| Comp. Ex. 2 | 55 | $15.4 \times 10^{-2}$ |

The oxidation starting time, i.e., the time when fracture of the silica film begins, depends on the thickness, purity and density of silica film, while the rate of oxidation depends mainly on the relative density to theoretical of the ceramic composite material.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, a current density in said terminal portions being at most 12 A/mm$^2$.

2. The infrared radiation source as claimed in claim 1, wherein said current density is at most 10 A/mm$^2$.

3. An infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, at least said terminal portions being disposed in dry air having a relative humidity at 25° C. of at most 30% (absolute humidity: 0.00588).

4. The infrared radiation source as claimed in claim 3, wherein the whole body of said illuminant is contained in a case wherein dry air is either sealed or flowed, and which is provided with a window for allowing outward emergence of infrared radiation.

5. The infrared radiation source as claimed in claim 3, wherein at least said terminal portions are disposed in dry air having an absolute humidity of substantially zero.

6. The infrared radiation source as claimed in claim 5, wherein the whole body of said illuminant is contained in a case wherein dry air is either sealed or flowed, and which is provided with a window for allowing outward emergence of infrared radiation.

7. An infrared radiation source comprising an illuminant having an illuminant portion and terminal portions, made of hot-pressed molybdenum disilicide reinforced with silicon carbide whiskers, and having a protective dense silica film of 5 to 20 μm in thickness formed on a surface thereof, a current density in said terminal portions being at most 12 $A/mm^2$, at least said terminal portions being disposed in dry air having a relative humidity at 25° C. of at most 30% (absolute humidity: 0.00588).

8. The infrared radiation source as claimed in claim 7, wherein the whole body of said illuminant is contained in a case wherein dry air is either sealed or flowed, and which is provided with a window for allowing outward emergence of infrared radiation.

9. The infrared radiation source as claimed in claim 1, wherein said illuminant is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

10. The infrared radiation source as claimed in claim 3, wherein said illuminant is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

11. The infrared radiation source as claimed in claim 7, wherein said illuminant is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

12. The infrared radiation source as claimed in claim 1, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

13. The infrared radiation source as claimed in claim 3, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

14. The infrared radiation source as claimed in claim 7, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

15. A heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, a current density in said terminal portions being at most 12 $A/mm^2$.

16. The heating source as claimed in claim 15, wherein said current density is at most 10 $A/mm^2$.

17. A heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, at least said terminal portions being disposed in dry air having a relative humidity at 25° C. of at most 30% (absolute humidity: 0.00588).

18. The heating source as claimed in claim 17, wherein the whole body of said heating element is contained in a case wherein dry air is either sealed or flowed, and which is provided with a window for allowing outward emergence of infrared radiation.

19. The heating source as claimed in claim 17, wherein at least said terminal portions are disposed in dry air having an absolute humidity of substantially zero.

20. The heating source as claimed in claim 19, wherein the whole body of said heating element is contained in a case wherein dry air is either sealed or flowed, and which is provided with a window for allowing outward emergence of infrared radiation.

21. A heating source comprising a heating element having a heating portion and terminal portions, made of hot-pressed molybdenum disilicide reinforced with silicon carbide whiskers, and having a protective dense silica film of 5 to 20 μm in thickness formed on a surface thereof, a current density in said terminal portions being at most 12 $A/mm^2$, at least said terminal portions being disposed in dry air having a relative humidity at 25° C. of at most 30% (absolute humidity: 0.00588).

22. The heating source as claimed in claim 21, wherein the whole body of said heating element is contained in a case wherein dry air is either sealed or flowed, and which is provided with a window for allowing outward emergence of infrared radiation.

23. The heating source as claimed in claim 15, wherein said heating element is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

24. The heating source as claimed in claim 17, wherein said heating element is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

25. The heating source as claimed in claim 21, wherein said heating element is a sintered composite made of molybdenum disilicide reinforced with silicon carbide whiskers, obtained by hot-pressing under a pressure of 200 to 500 $kg/cm^2$ at a temperature of 1,700 to 1,850° C. over a period of time of 10 minutes to 5 hours, and having a relative density to theoretical of at least 98%.

26. The heating source as claimed in claim 15, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

27. The heating source as claimed in claim 17, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

28. The heating source as claimed in claim 21, wherein said protective silica film is obtained by subjecting said hot-pressed molybdenum disilicide reinforced with silicon carbide whiskers to a pre-oxidation treatment in an atmosphere of air at a temperature 1,500 to 1,700° C.

29. An infrared radiation source comprising:

an illuminant having an illuminant portion for emitting infrared radiation and terminal portions, said illuminant being made of hot-pressed molybdenum disilicide reinforced with silicon carbide whiskers; and a protective dense silica film formed on said illuminant, said silica film having a thickness of 5 to 20 $\mu$m.

30. An infrared radiation source as in claim 29, further comprising:

a case enclosing said illuminant, said case having a window for outputting said infrared radiation; and means for introducing dry air into said case.

31. A method of producing an infrared radiation source, comprising the steps of:

hot-pressing molybdenum disilicide reinforced with silicon carbide whiskers to form an illuminant having an illuminant portion and terminal portions; and forming a protective dense silica film on a surface of said illuminant, said silica film having a thickness of 5 to 20 $\mu$m.

32. The method of claim 31 wherein the step of forming a protective dense silica film on a surface of said illuminant comprises the step of:

subjecting said illuminant and terminal portions to a pre-oxidation treatment in an atmosphere of air at a temperature of 1,500 to 1,700° C.

33. The method of claim 31 wherein said hot-pressing is performed at a pressure of 200 to 500 kg/cm3 and a temperature of 1,700 to 1,850° C. for a period of 10 minutes to 5 hours.

* * * * *